United States Patent [19]

Williams

[11] Patent Number: 4,599,851

[45] Date of Patent: Jul. 15, 1986

[54] DRY TONER CARTRIDGE SYSTEM AND METHOD OF FILLING SAME

[75] Inventor: Brian L. Williams, West Hurley, N.Y.

[73] Assignee: Marpac Industries, Inc., Allendale, N.J.

[21] Appl. No.: 657,790

[22] Filed: Oct. 4, 1984

[51] Int. Cl.[4] ..... B65B 7/28; B65B 1/28

[52] U.S. Cl. ..... 53/471; 53/487; 206/631

[58] Field of Search ..... 206/631; 141/2, 18, 141/29; 222/DIG. 1; 53/487, 485, 471, 467, 329, 297, 296

[56] References Cited

U.S. PATENT DOCUMENTS

| | | | |
|---|---|---|---|
| 3,658,238 | 4/1972 | Nedstedt | 206/631 X |
| 4,184,310 | 1/1980 | Shelby | 53/297 X |
| 4,287,998 | 9/1981 | Zimmermann | 206/631 X |
| 4,295,904 | 10/1981 | Schmit | 53/485 X |
| 4,312,450 | 1/1982 | Reil | 206/631 X |
| 4,365,457 | 12/1982 | Schellenberg | 53/487 X |
| 4,469,258 | 9/1984 | Wright et al. | 206/631 |

*Primary Examiner*—James F. Coan

*Attorney, Agent, or Firm*—W. Patrick Quast

[57] ABSTRACT

In a toner cartridge system including a container having a dry toner storage area and dry toner dispensing opening with a flange portion, a removeable, heat sealed strip tape including a flange portion for coacting with the flange portion of the toner dispensing opening to cover the opening, the improvement wherein the flange portion of the strip tape which coacts with the flange surrounding the dispensing opening includes preconfigured openings of suitable shape to complement the toner filler nozzle. Disclosed configurations for the opening include a substantially circular one, a simple slit and two slits orthogonal to each other.

8 Claims, 9 Drawing Figures

DRY TONER CARTRIDGE SYSTEM AND METHOD OF FILLING SAME

BACKGROUND OF THE INVENTION

1. Field of the Invention

This invention relates generally to an improved cartridge system and method of filling same for dry toner applications in the copier and printer field.

2. Description of the Prior Art

For an understanding of how cartridges are presently filled for subsequent use in copier and printing applications, where dry toner particles are utilized, a reference to FIG. 1, at this point, would be helpful. FIG. 1 depicts in perspective view the prior art approach for filling dry toner cartridges for use in copier and printing machines. The prior art toner cartridges can include a storage portion 12. Access to the storage portion for filling the cartridge is through fill hole 14. Routinely, the dry toner filling machine would include a communicating nozzle arrangement which would be inserted in the fill hole. Dry toner would then be forced in from the filling machine into the cartridge through the fill hole.

Prior to inserting the filler nozzle in hole 14, the open area of the cartridge, 16, would have to be covered. Typically, the open area includes a flanged surface, 18, which is stippled to facilitate adhesion of the heat seal strip tape, 20. Part of the tape is cut away in FIG. 1 to show a notch opening, 22, in the flange, 18. After the tape is sealed to the flanged surface, slide closure 24 is placed on the container and locks itself to the flange member 18 through a communicating protrusion which engages the notch 22. Once the dispensing area is closed as just described, the filling nozzle is inserted into the fill hole, 14, and the toner particles injected into the cartridge. After completion of the filling operation, a fill hole plug, 26, is press-fitted into the fill hole.

Thereafter, at the user's location, the operator would grasp handle 28 and insert the loaded cartridge into the copier or printing machine hopper. This would be subsequent to removal of the slide closure member 24. For the container shown, the dispensing area would be inverted from the depicted upright position. After the container, with slide closure removed, was inserted into the proper location in the copier or printer hopper, the operator would grasp the tail 30 of the heat sealed tape and by drawing it towards him in the direction of the arrow, 32, would break the seal between the tape and the flange, 18, allowing him to remove the tape completely. The toner particles would then discharge into the hopper, completing the charging of the machine.

It has been the experience of the applicant's assignee, that the sealing of the fill hole 14, employing the plug type seal 26 is a difficult operation, particularly in mass production situations.

Where the toner cartridge does not include a fill hole such as 14, charging of the cartridge occurs by directly placing the nozzle into the dispensing area opening. However, because of the fineness normally associated with dry toner particles, powder toner clouds develop which result in a residue collecting in the flange area, such as 18. If not completely wiped off, this contaminates the subsequent seal between the tape and the flange giving rise to possible problems in the field.

Therefore, it is a primary objective of this invention to provide a toner cartridge system for dry toner application which eliminates these problems and yet retains some of the basic aspects of the previous designs.

It is yet another objective of this invention to provide a dry toner cartridge filling system which eliminates or substantially minimizes the development of powder toner clouds during the charging process, thus avoiding contamination of the work place which could lead to explosions and/or fires.

SUMMARY OF THE INVENTION

Towards the accomplishment of these objectives and others which will be more readily apparent from a study of the accompanying drawings and the following specification, in a dry toner cartridge system including a container having a toner storage area and toner dispensing opening with a flange portion, a removeable, adhesive strip tape including a flange portion for coacting with the flange portion of the toner dispensing opening to cover the opening, the improvement wherein the flange portion of the strip tape which coacts with the flange surrounding the dispensing opening includes preconfigured openings of suitable shape to complement the toner filler nozzle. Disclosed configurations for the opening include a circular one, a simple slit and two slits orthogonal to each other.

FIG's. 2A, 2B and 2C are perspective views of a portion of the improved toner cartridge system showing a step by step operation from the filling of the cartridge through its final slide closing prior to shipment.

Figure 3:
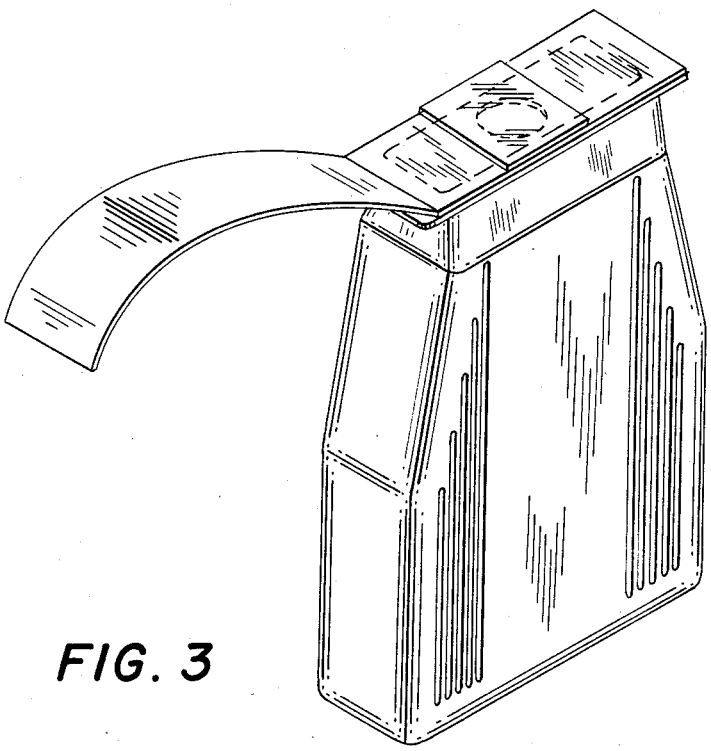

FIG. 3 is an embodiment of yet another cartridge system employing the principles of the present invention.

FIG's. 4A, 4B and 4C are plan views of three different ways of working the heat seal adhesive tape to effect a fill opening.

DESCRIPTION OF THE PREFERRED EMBODIMENT

Figure 1:
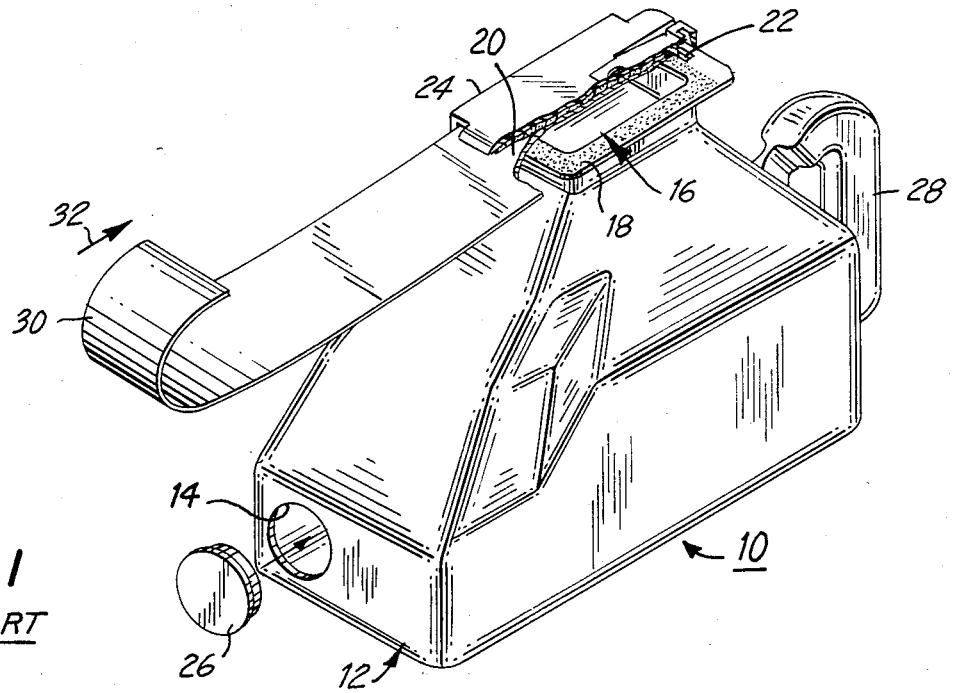
FIG. 1 PRIOR ART
FIG. 1 is a perspective view, partially in section, depicting the prior art version of a typical dry toner cartridge for copying.
Figure 2:
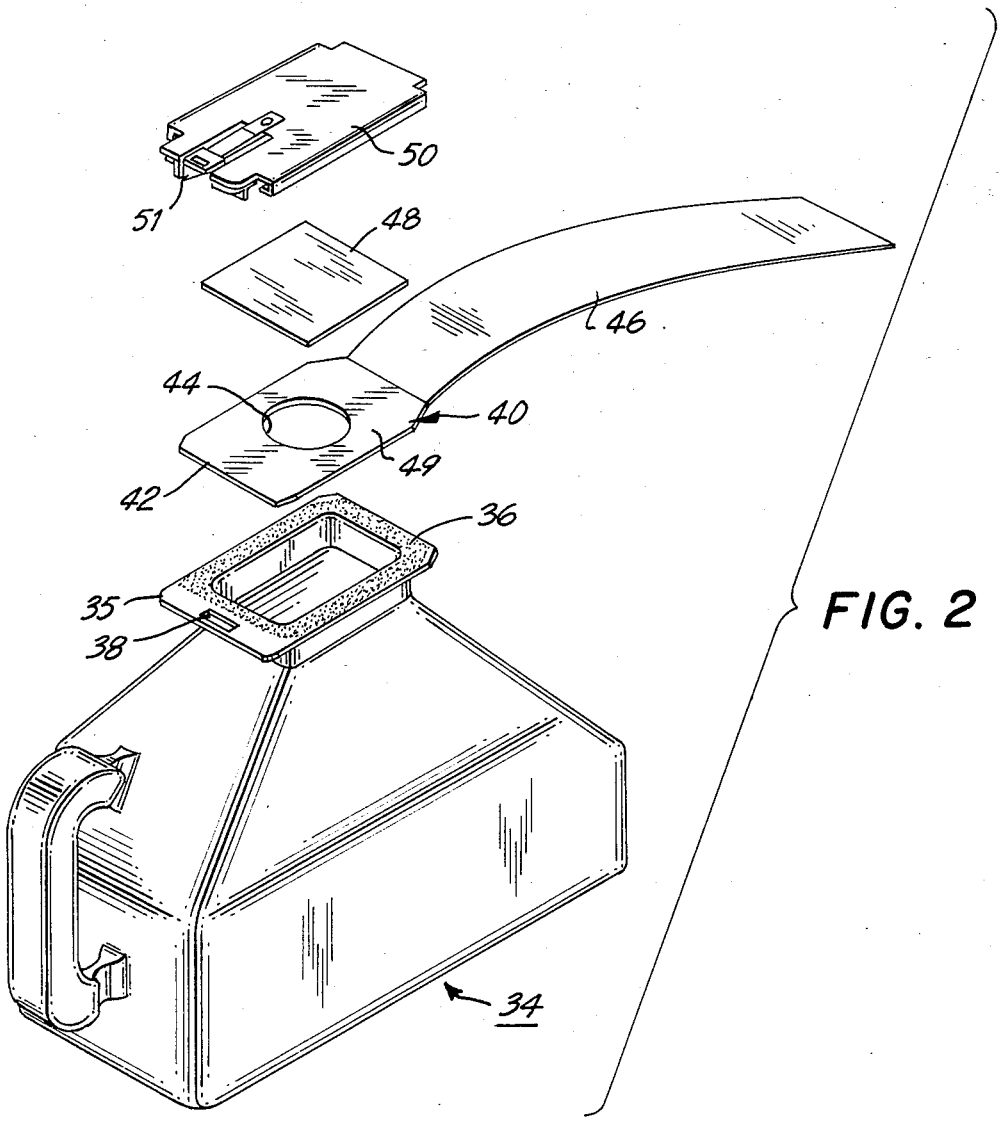
FIG. 2 is a perspective, exploded view of the invention showing the improved design.

FIG. 2, again, is a perspective, exploded view of the improved cartridge system. A dry toner cartridge, 34, such as used typically for supplying dry toner for use in copying machines is depicted. This is substantially identical to the prior art toner cartridge, shown in FIG. 1, except that the fill hole, e.g. 14, does not exist. The toner cartridge is made of thermoplastic. It includes the flange member 35 which has the stippled surface 36. The flange member 35 is also notched as at 38 for the same purpose as the prior art cartridge.

A heat sealed strip tape, 40, includes a flange covering portion, 42, having a filling opening, such as hole 44. The heat sealed strip tape, 40, further includes an integral tail member, 46.

Prior to filling of the toner cartridge the tape, 40, is positioned on the flange member 36, and sufficient heat and pressure applied to result in its adhesion to the flange. A heat sealing tape, can be obtained from various suppliers. A typical material would be DuPont's TYVEK heat sealable tape.

After the cartridge is filled with toner, sealing tape 48 is applied to the outboard surface of the heat sealed strip tape in the immediate vicinity of the fill hole. Because the filling nozzle is placed down into the fill hole, and because the hole in the tape is cut to provide a relatively tight fit between the hole and the filling nozzle, dry toner particles do not disburse on to the TYVEK surface, 49. Therefore, the sealing tape, 48, can adhere relatively easily.

The filled and sealed cartridge is then closed with a slide closure 50 which includes a spring bias member, 51, which engages the notch 38 in the flange. The cartridge system is now ready for shipment to the end user.

Figure 2A:
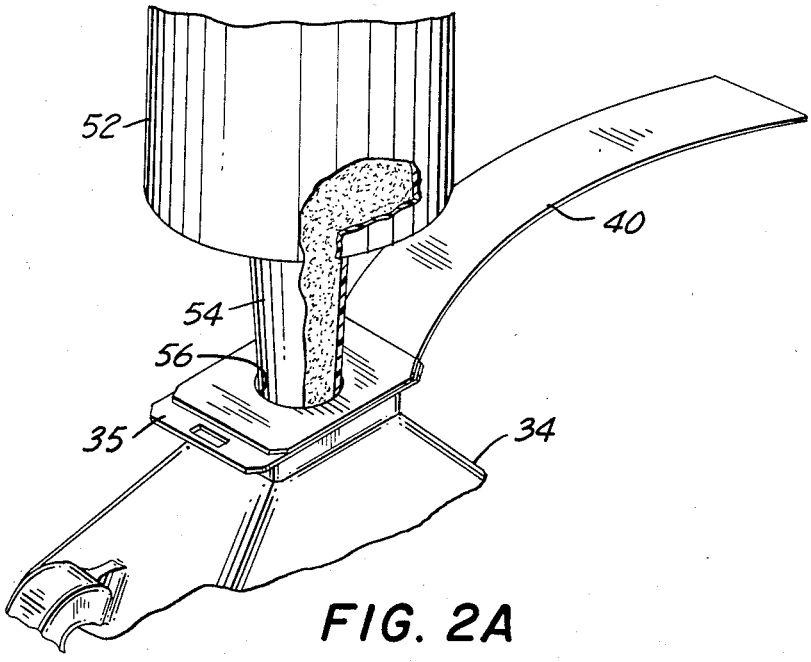
Figure 2B:
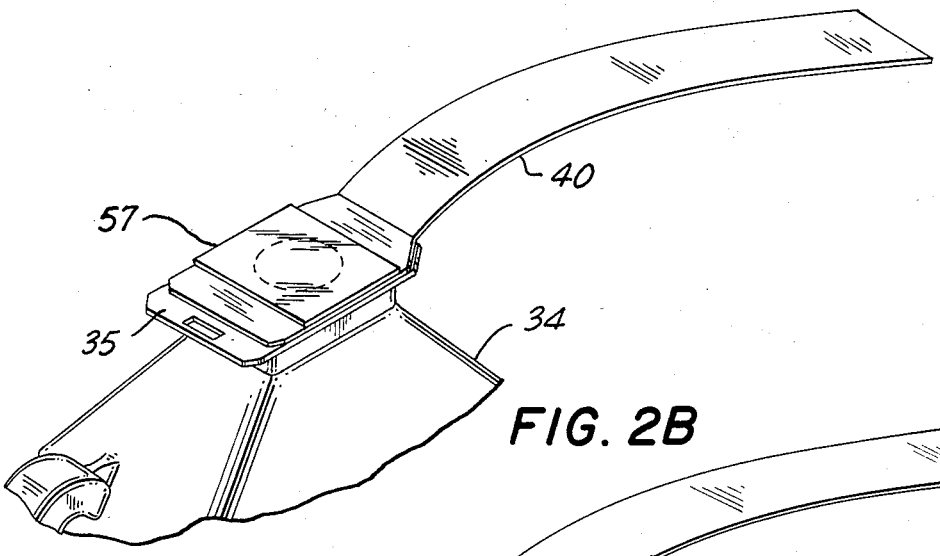
Figure 2C:
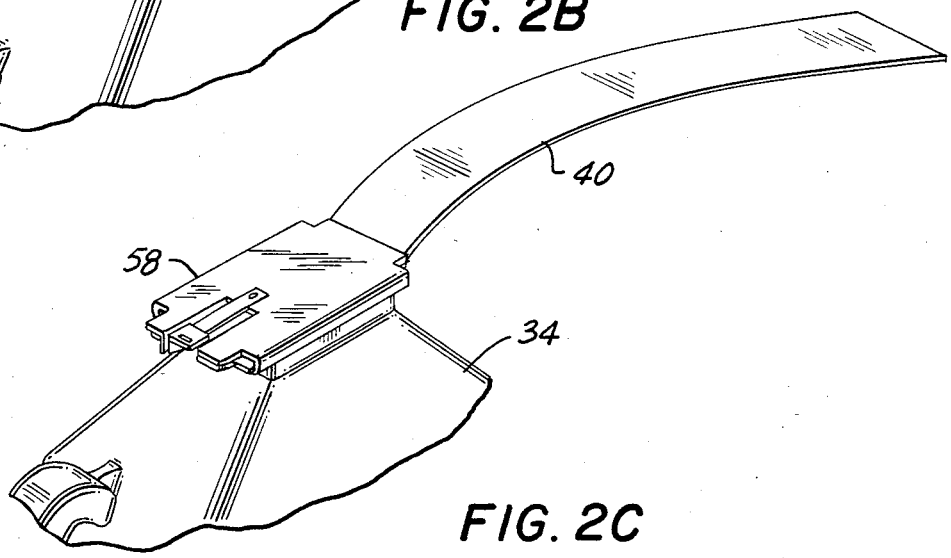

FIG's. 2A, 2B and 2C depict the appearance of the cartridge system at the various stages of assembly. In FIG. 2A, the toner supply filling machine, 52, is shown in a vertically disposed position above the container, 34. The filling nozzle, 54, of the filling machine nests into the opening, 56, on tape 40. Again, FIGS. 2B and 2C show the subsequent application of the sealing tape, 56, and the slide closure, 50.

FIG. 3 shows yet another version of the improved cartridge filling system for a differently configured container.

Figure 4A:
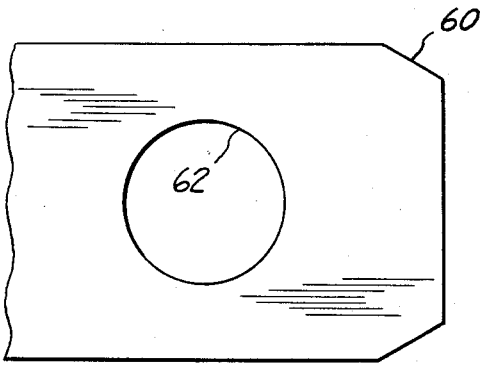
Figure 4B:
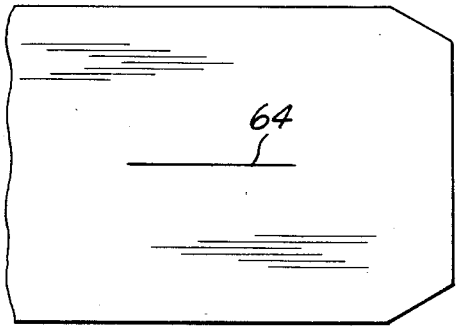
Figure 4C:
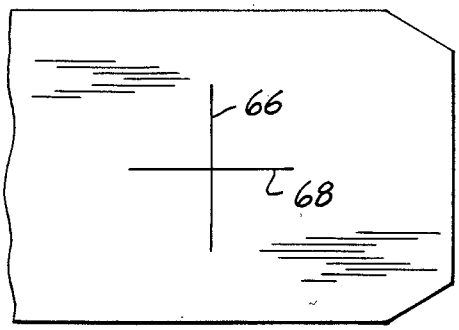

FIG. 4A is a plan view depicting a flanged flap portion, 60, of the heat seal strip tape covering the flanged area of the container. It includes a fill hole such as 62; or, is fashioned by a slit 64 along the longitudinal axis of the heat seal strip; or by cross slits such as 66 and 68 as depicted in FIG. 4C. Further, the slit as 64 in FIG. 4B could be singular and perpendicular to the longitudinal axis of the heat seal strip.

Other variations on the design disclosed would now be obvious to those of ordinary skill in the art. The scope of the invention is not to be limited by the embodiment described but is determined by the breadth of the claims appended hereto.

What is claimed is:

1. In a dry toner cartridge system including a container having a toner storage area and toner dispensing opening with a flange portion, a removeable, adhesive strip tape including a flange portion for coacting with the flange portion of the toner dispensing opening to cover the opening, the improvement wherein the flange portion of said strip tape which coacts with the flange portion of the toner dispensing opening includes a fill port of predetermined configuration into which a nozzle for filling said container with dry toner is placed, said fill port of predetermined configuration designed to permit entry of the nozzle to enable filling the container with the toner, said fill port of predetermined configuration further designed to substantially impede the development of toner clouds outside the container during the filling operation by nesting substantially closely about the nozzle.

2. In a dry toner cartridge system including a container having a toner storage area and toner dispensing opening with a flange portion for coacting with the flange portion of the toner dispensing opening to cover the opening, the improvement wherein the flange portion of said strip tape which coacts with the flange portion of the toner dispensing opening includes a fill port of predetermined configuration into which a nozzle for filling said configuration with toner is placed, said fill port of predetermined configuration designed to permit entry of the nozzle to enable filling the container with the toner, said fill port of predetermined configuration further designed to substantially impede the development of toner clouds outside the container during the filling operation by nesting substantially closely about the nozzle, the system further comprising means for sealing the fill port after the toner filling operation.

3. The system claimed in either claim 1 or claim 2 wherein said fill port is substantially circular in configuration.

4. The system claimed in either claim 1 or claim 2 wherein said fill port comprises at least one slit, cut into said flange portion of the tape.

5. The system claimed in claim 4 wherein said fill port comprises two slits cut into the flange portion of said tape, said slits intersecting each other at a predetermined angle.

6. The system claimed in claim 5 wherein said predetermined angle is ninety degrees.

7. An improved method for filling a dry toner cartridge having a toner storage area and toner dispensing opening with a flange portion for receiving means for sealing the toner dispensing opening including removeable tape means, the improved method comprising: cutting an opening of predetermined configuration into the portion of the tape means covering the toner dispensing opening into which the nozzle for filling said container with the dry toner can be placed, said opening of predetermined configuration designed to permit entry of the nozzle to enable filling the container with the toner, said fill port of predetermined configuration further designed to substantially impede the development of toner clouds outside the container during the filling operation by nesting substantially closely about the nozzle; and applying the removeable tape means to the flange portion of said toner dispensing opening, such that said opening of predetermined configuration is positioned over part of the toner dispensing opening.

8. The improved method of claim 7 further comprising the steps of filling the toner cartridge with dry toner; and sealing the opening of predetermined configuration in the tape means covering the toner dispensing opening.

* * * * *